United States Patent [19]

Kramp et al.

[11] 4,254,215

[45] Mar. 3, 1981

[54] PROCESS FOR THE PREVENTION OF DARKENING AND THE FORMATION OF A SEDIMENT IN PHOTOGRAPHIC DEVELOPER SOLUTIONS

[75] Inventors: Ekkehard Kramp; John Lenoir; Max Marthaler, all of Marly, Switzerland

[73] Assignee: Ciba-Geigy AG, Basel, Switzerland

[21] Appl. No.: 24,287

[22] Filed: Mar. 26, 1979

[30] Foreign Application Priority Data

Mar. 31, 1978 [CH] Switzerland ..... 3478/78
Feb. 16, 1979 [CH] Switzerland ..... 1547/79

[51] Int. Cl.[2] ..... G03C 5/30; G03C 5/38

[52] U.S. Cl. ..... 430/419; 430/456; 430/488

[58] Field of Search ..... 96/61 M, 66.5, 66.4, 96/29 R, 66 R, 61 R, 109, 59, 66.1, 66.2

[56] References Cited

U.S. PATENT DOCUMENTS 3,607,904 9/1971 Willems ..... 96/109
3,685,991 8/1972 Grasshoff et al. ..... 92/29 R
3,932,480 1/1976 Grasshoff et al. ..... 96/66.5
4,141,734 2/1979 Lenoir et al. ..... 96/61 M

FOREIGN PATENT DOCUMENTS 604151 6/1948 United Kingdom ..... 96/109
997031 6/1965 United Kingdom ..... 96/107

*Primary Examiner*—Mary F. Downey
*Attorney, Agent, or Firm*—Sprung, Felfe, Horn, Lynch & Kramer

[57] ABSTRACT

A process is described for the prevention of darkening and the formation of a sediment in photographic developer solutions which contain a silver halide developer, a water-soluble silver halide solvent and organic sulfur compounds. The organic sulfur compounds are a combination of (a) an organic thiol compound or thione compound capable of tautomerism and (b) a Bunte salt which contains groups conferring solubility in water. Developer solutions which contain the indicated combination of sulfur compounds are outstandingly stable.

21 Claims, No Drawings

PROCESS FOR THE PREVENTION OF DARKENING AND THE FORMATION OF A SEDIMENT IN PHOTOGRAPHIC DEVELOPER SOLUTIONS

When photographic materials containing silver halide are processed, developing is in the main carried out in an alkaline medium and o- or p-dihydroxybenzenes, aminophenols, diaminobenzenes, pyrazolidinones, reductones or hydroxylamine derivatives are used as developer substances. Usually, the developer solution also contains further additives, such as salts of sulfurous acid for stabilising, anti-fogging agents and buffer substances. Furthermore, it is also known to develop photographic material in certain cases in the presence of silver halide solvents. Such silver halide solvents are, for example, organic compounds of divalent sulfur, such as mercapto compounds, thioethers, thioamides or compounds containing an acid —CH grouping, for example bis-methylsulfonylmethane, and also salts of thiocyanic acid or salts of sulfurous acid in high concentration, but especially salts of thiosulfuric acid.

Developers containing such additives are known as fine-grain developers and in-grain developers. (cf. E. Mutter, "Die Technik der Negativ- und Positivverfahren" ("The Techniques of Negative and Positive Processes"), Springer 1955, page 158 to 159). The developing of latent silver nuclei inside the grains is of particular importance in the case of reversal development processes, in which salts of thiocyanic acid are frequently added to the first developer. Further important embodiments of this type are the monobaths, such as are described, say, in U.S. Patent Specification No. 3,857,710 or by G. Haist in "Monobath Manual", Morgan 1960. A further embodiment of this type is a masking developer for the silver dye-bleach process as described in German Offenlegungsschrift No. 2,547,720.

However, many of these developers have the disadvantage that they more or less rapidly reduce the silver halide dissolved in the form of a complex from the photographic material. As a result of this a turbidity and, after some time, a sediment of silver form in the developer and this sediment can adhere both to the photographic material and to parts of the developing equipment. This formation of a sediment proves particularly disadvantageous in the case of equipment which operates continuously. There has been no lack of attempts to find suitable measures against the formation of a silver sediment.

In German Offenlegungsschrift No. 2,437,353 it is proposed to use derivatives of 1-phenyl-5-mercaptotetrazole in developer for X-ray film to counter the deposition of silver in developing equipment. In U.S. Patent Specification No. 3,173,789 and in German Auslegeschrift 1,175,077 and German Offenlegungsschrift No. 2,003,414 heterocyclic mercapto compounds, and in German Offenlegungsschrift No. 1,909,743 aliphatic mercaptocarboxylic acids, are described as additives to processing solutions to combat the formation of a silver sediment. In U.S. Patent Specification 3,318,701, α-liponic acid, and in German Offenlegungsschrift No. 2,040,801 4-acylamino-1,2,3-triazoline-5-thiones, are proposed to counter the formation of a sediment. These substances are usually employed in amounts of between 5 and 5,000 mg per liter of developer solution.

It has been found that the proposed additives can delay the formation of a silver sediment for a certain period, but they have diverse undesired side effects. Substances which have a good clarity-preserving effect have a considerable influence on the characteristics of the developer. In the case of multi-layer colour materials, in particular the sensitivity of the uppermost layer is reduced. When silver dye-bleach materials are subjected to masking developing, disturbances in the masking effect arise. Other substances are unstable in the developer, lose effectiveness rapidly due to atmospheric oxidation or decompose with the formation of secondary products which are malodorous and/or harmful to health. The practical application of the clarity-preserving substances proposed hitherto is made considerably more difficult and in many cases impossible as a result of all of these disadvantages. Finally, in German Offenlegungsschrift No. 2,640,659 a developing process is described in which specific organic di- or tri-sulfides are used to preserve the clarity of developer solutions.

These di- and tri-sulfides are indeed already very suitable for preserving the clarity of, and for preventing the formation of a silver sediment in, photographic developer solutions, but they have the disadvantage that they are accessible by synthesis only with difficulty and, furthermore, that they have to be employed in relatively large amounts in the developing bath in order to obtain the desired effects.

The object of the present invention is, therefore, to provide a novel process for the prevention of darkening and the formation of a sediment in photographic developer solutions, with which process impairment of photographic developing should be largely excluded.

It has now been found that this object can be achieved if a combination of a mercapto compound and a Bunte salt is added to the developer solutions.

It is true that German Offenlegungsschrift No. 1,768,400 already describes the use of Bunte salts in the photographic field, for example as stabilisers for silver halide emulsions or for stabilising photographic materials which have been developed. In contrast to this, however, the Bunte salts according to the present invention are employed in combination with a mercapto compound in developer solutions and are used for a different purpose.

The present invention relates to a process for the prevention of darkening and the formation of a sediment in photographic developer solutions which contain a compound which develops silver halide, a water-soluble silver halide solvent and organic sulfur compounds, which comprises adding to the developer solution, as organic sulfur compounds, a combination of (a) an organic thiol compound or thione compound which is capable of tautomerism and (b) a Bunte salt containing groups which confer solubility in water.

The thiol compounds or thione compounds capable of tautomerism are compounds of the formulae $$HS—D—(W)_n \quad (1)$$

or $$S{=}\underset{R_1}{\underset{|}{C}}—\underset{R_2}{\underset{|}{A}}—H\,, \quad (2)$$

whilst the Bunte salts have the formula $$(Z)_m—E—(B)_{r-1}—SSO_3M \quad (3)$$

in which formulae A is a nitrogen atom, a carbon atom bonded via a double bond

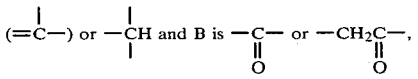

$R_2$ is hydrogen, substituted or unsubstituted alkyl, substituted or unsubstituted phenyl or a substituted or unsubstituted, saturated or unsaturated 5-membered or 6-membered heterocyclic radical containing nitrogen, oxygen and/or sulfur atoms and $R_1$ has the meaning defined for $R_2$ with the exception of hydrogen, or $R_1$ and $R_2$ together with the atoms to which they are bonded form a 4-membered, 5-membered or 6-membered heterocyclic ring, D and E are each a substituted or unsubstituted aliphatic, araliphatic, cycloaliphatic, aromatic or heterocyclic radical and W and Z are each a radical of the formulae

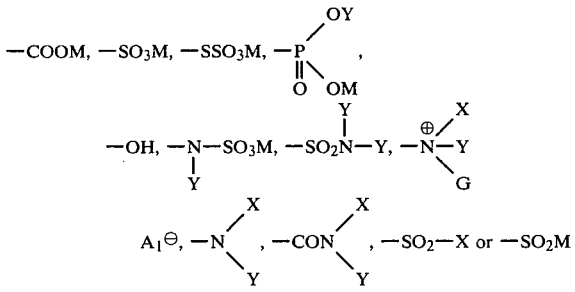

or a polyoxyethylene radical which has 2 to 20 oxyethylene units and can be sulfonated, in which formulae G, X and Y are each hydrogen or are alkyl having 1 to 6 carbon atoms which is substituted by hydroxyl, carboxyl or —$SO_3H$ and Y is also phenyl, phenylsulfonic acid, alkylsulfonyl having 1 to 5 carbon atoms, phenylsulfonyl or tolylsulfonyl, M is a monovalent cation and $A_1^{\Gamma}$ is a monovalent anion, and n and m are each an integer from 1 to 4 and r is 1 or 2. If r is 1, the Bunte salts have the formula $(Z)_m$—E—$SSO_3M$, in which the symbols are as defined.

The invention also relates to the developer solution for carrying out the process, the concentrates for preparing the developer solutions, the use of the process when developing photographic black-and-white, reversal, chromogenic, X-ray or silver dye-bleach material and also the use of the combination of components (a) and (b) as the additive which suppresses darkening and the formation of a sediment (silver sediment) in photographic developer solutions.

In the mercapto compounds of the formula (1), D is, for example, a substituted or unsubstituted, saturated or unsaturated aliphatic radical having not more than 40 and preferably not more than 20 carbon atoms, preferred radicals being straight-chain (—$(CH_2)_x$—, x=1 to 40) or branched alkylene and alkylidene having not more than 10 carbon atoms. The alkylene and alkylidene bridge members can, if desired, also be interrupted by —O—, —$SO_2$— or —NH— or —NR— (R=$C_1$—$C_4$-alkyl). In addition to alkyl (formation of the branched radicals), for example alkyl having 1 to 5 carbon atoms-methyl, ethyl, n-propyl, n-butyl, n-amyl and isomeric radicals-, substituents can be carboxyl, carboxyalkyl having 1 to 3 carbon atoms in the alkyl moiety, especially carboxymethyl, hydroxyl, mercapto (—SH) and also hydroxy- or mercapto-alkyl each having, for example, 1 to 3 carbon atoms (hydroxymethyl, hydroxyethyl, hydroxypropyl and the corresponding radicals containing mercapto groups). If the substituents are mercapto or mercaptoalkyl groups, the mercaptans of the formula (1) are dimercaptans or can also be polymercaptans.

If the bridge member D is a substituted or unsubstituted aliphatic radical, which likewise can contain not more than 40 carbon atoms, such radicals are, in particular, benzylene or phenylethylene radicals, which can be substituted on the phenyl ring by halogen (fluorine, chlorine or bromine), hydroxyl, amino (—$NH_2$), —$SO_3H$ or —$SO_2NH_2$.

The cycloaliphatic radicals are in particular derived from cycloalkyl having 1 to 4 cycloalkyl rings and 5 to 10 carbon atoms and preferably having 5 or 6 carbon atoms. Examples are cyclopentyl, cyclohexyl, norbornyl or 1-adamantyl radicals.

The aromatic radicals are as a rule those which are derived from mononuclear or polynuclear, substituted or unsubstituted aromatic compounds having a total of not more than 40 carbon atoms, but especially those derived from benzene. Phenylene is preferred and this can contain, as substituents, alkyl, for example having 1 to 4 carbon atoms, halogen, for example fluorine, chlorine or bromine, hydroxyl, amino (—$NH_2$), —COOH, —$SO_3H$ or —$SO_2NH_2$, alkyl, halogen and amino being preferred.

If the bridge member D is a substituted or unsubstituted heterocyclic radical, these radicals are as a rule saturated or unsaturated 5-membered or 6-membered radicals containing nitrogen, oxygen and/or sulfur atoms, for example pyridyl, pyrimidyl, pyridazyl, pyrazolyl, pyrryl, triazinyl, imidazolyl, the triazolyl and tetrazolyl radicals, the oxazolyl and thiazolyl radicals, furyl or thienyl; further radicals are morpholinyl, imidazolinyl, imidazolidinyl, pyrrolidinyl, pyrrolidinonyl, tetrahydrofuryl or piperidinyl.

The radicals can, thus, contain 1 to 4 nitrogen atoms, one oxygen atom and/or one sulfur atom. Examples of fused systems are benzimidazoles, quinoxalines, benzoxazoles and benzthiazoles.

In the mercapto compounds of the formula (1),

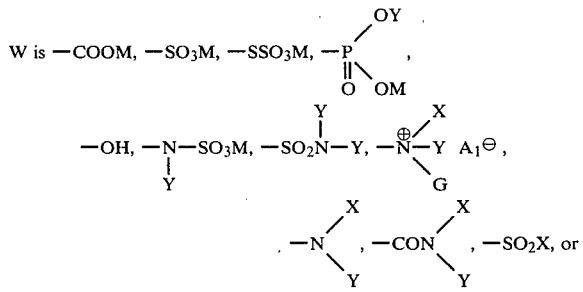

—$SO_2M$ or a polyoxyethylene radical which has 2 to 20 oxyethylene units and can be sulfonated. G, X and Y independently of one another can be hydrogen or substituted alkyl having 1 to 6 carbon atoms, possible substituents being hydroxyl, carboxyl or —$SO_3H$; Y can also be phenyl, phenylsulfonic acid

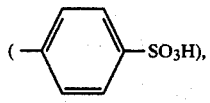

alkylsulfonyl having 1 to 5 carbon atoms in the alkyl moiety ($CH_3$-$SO_2$—, $C_2H_5$-$SO_2$—, $C_3H_7SO_2$—, i—$C_3H_7SO_2$—, $C_4H_9SO_2$— or $C_5H_{11}SO_2$—), phenylsulfonyl

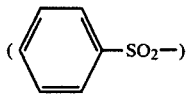

or tolylsulfonyl

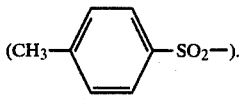

G, X and Y together with the nitrogen atom can, furthermore, also form a saturated or unsaturated 5-membered or 6-membered ring, for example a pyridinium ring. M is a monovalent cation, especially the hydrogen cation ($H^{\oplus}$), and also an alkali metal cation ($Na^{\oplus}$ or $K^{\oplus}$) or an ammonium cation ($NH_4^{\oplus}$). $A_1^{\ominus}$ is a monovalent anion, for example $Br^{\ominus}$, $Cl^{\ominus}$, $CH_3OSO_3^{\ominus}$ or

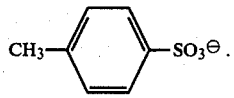

The radicals W in the compounds of the formula (1) are groups which confer solubility in water; the number of such radicals can be up to 4 (n=1 to 4) and the preferred compounds contain 3, 2 or especially only one of the radicals W.

The compounds of the formula (2) contain a C=S grouping which is capable of tautomerism and can therefore be described as follows.

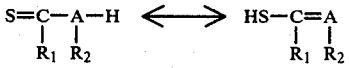

For reasons of simplicity, in every case only one tautomeric form is indicated in the present specification, without, however, this excluding the other form.

A is a nitrogen atom

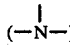

a carbon atom bonded via a double bond

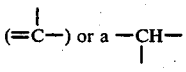

grouping.

$R_2$ is hydrogen or also substituted or unsubstituted alkyl, for example having 1 to 10 carbon atoms and containing, for example, the substituents hydroxyl, amino, alkyl ($C_1$-$C_4$), halogen (fluorine, chlorine or bromine), —$SO_3M$ or —$SO_2NH_2$; furthermore, $R_2$ can be substituted or unsubstituted phenyl, possible substituents being alkyl ($C_1$-$C_4$), halogen (fluorine, chlorine or bromine), hydroxyl, amino, carboxyl, —$SO_3H$ or —$SO_2NH_2$; $R_1$ has the meaning defined for $R_2$ with the exception of hydrogen; if $R_1$ and $R_2$ are the radicals of substituted (substituents as for phenyl) or unsubstituted, saturated or unsaturated 5-membered or 6-membered heterocyclic compounds containing nitrogen, oxygen and/or sulfur atoms, the radicals of heterocyclic compounds such as those mentioned under D can also be used here. If desired, the radicals $R_1$ and $R_2$ together can be the atom grouping which is still required to form a 4-membered, 5-membered or 6-membered heterocyclic ring with the grouping

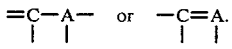

Heteroatoms are the nitrogen, oxygen and/or sulfur atom.

E in the Bunte salts of the formula (3) has the meaning defined for D in the mercapto compounds of the formula (1) and D and E can be identical or different to one another. In addition, however, E can also be a bridge member of the formula —$(CH_2)_{s-1}$ $CONH(CH_2)_{t-1}$—, in which s and t are each an integer from 1 to 3. Z has the meaning defined for W, and in this case also the two symbols can have identical or different meanings.

B in the Bunte salts of the formula (3) is

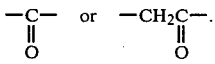

The grouping —E—B— in —E—B—$SSO_3M$— (r=2) can additionally be, for example, acetyl or benzoyl, which are unsubstituted or substituted by alkyl ($C_1$-$C_3$), preferably methyl, or halogen, preferably chlorine, for example:

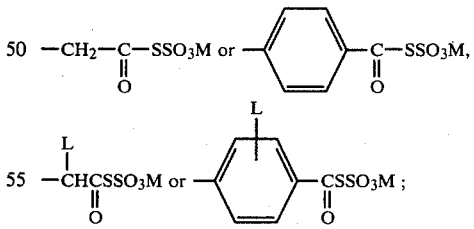

(L = substituent - alkyl or halogen).

The combination of (a) and (b) used in the process according to the invention is preferably a combination in which component (a) is a mercaptan of the formula $$HS—D_1—(W_1)_{n1} \quad (4)$$

and component (b) is a Bunte salt of the formula $$(Z_1)_{m1}—D_1—SSO_3M \quad (5)$$

in which formulae $D_1$ in each case is a substituted or unsubstituted aliphatic, araliphatic or aromatic radical having not more than 40 carbon atoms or a heterocyclic 5-membered or 6-membered ring which contains 1 to 4 nitrogen atoms, one oxygen atom and/or one sulfur atom and can be fused with a benzene ring, $W_1$ is $$-COOM,\ -SO_3M,\ -OH \text{ or } CON\begin{matrix}X\\Y\end{matrix} \text{ and } Z_1 \text{ is } -COOM,$$

$$-SO_3M,\ -SSO_3M,\ -OH,\ -CON\begin{matrix}X\\Y\end{matrix} \text{ or } -N\begin{matrix}X\\Y\end{matrix},$$

$n_1$ and $m_1$ in each case are an integer from 1 to 3 and M, X and Y are as defined.

The symbols $D_1$ in the formulae (4) and (5) can be identical or different to one another.

Very suitable mercaptans of the formula (4) have the formula $$HS-D_2-(W_1)_{n2} \quad (6)$$

in which $D_2$ is an aliphatic or araliphatic radical having not more than 20 carbon atoms or a substituted or unsubstituted benzene radical and $n_2$ is 1 or 2 and $W_1$ is as defined, and these mercaptans advantageously also have the formula $$HS-D_2-(W_2)_{n2} \quad (7)$$

and are employed in combination with the Bunte salts of the formula $$(Z_2)_{m2}-D_2-SSO_3M \quad (8)$$

in which formulae $D_2$ is as defined, $W_2$ is —COOH or $-SO_3M$, $Z_2$ is —COOM, $-SO_3M$, $-SSO_3M$, $-NH_2$ or —OH and M is a monovalent cation and $n_2$ and $m_2$ are each 1 or 2.

The substituents on the benzene radical are, for example, alkyl having 1 to 4 carbon atoms, halogen (chlorine or bromine), hydroxyl, amino, carboxyl, sulfo ($-SO_3H$) or sulfonamide ($-SO_2NH_2$), and one or more of these substituents can be present.

The symbols $D_2$ in the formulae (7) and (8) can be identical or different to one another.

If the mercaptans of the formula (7) contain an aromatic bridge member $D_2$, particularly preferred mercaptans are those of the formula $$HS-D_3-COOM \quad (9)$$

In this formula, $D_3$ is phenylene, which can be unsubstituted or substituted by alkyl having 1 to 4 carbon atoms, halogen, especially chlorine, or amino ($-NH_2$), whilst M is a monovalent cation, especially hydrogen ($H^{\oplus}$).

A particularly valuable combination of components (a) and (b) which can be used in the process according to the invention contains, as component (a), a mercaptan of the formula $$HS-\left[\begin{matrix}R_3\\|\\C\\|\\R_4\end{matrix}\right]_{2-p}-R_5-W_2 \quad (10)$$

and, as component (b), a Bunte salt of the formula $$(Z_2)_{m2}-R_{12}-\left(\begin{matrix}CH\\|\\R_{11}\end{matrix}\right)_{2-q}-SSO_3M \quad (11)$$

in which formulae $R_3$ is hydrogen, alkyl having 1 to 5 carbon atoms, carboxyl, carboxyalkyl having 1 to 3 carbon atoms in the alkyl moiety, phenyl, which is unsubstituted or substituted by alkyl having 1 to 4 carbon atoms, halogen, hydroxyl, amino, $-SO_3H$, —COOH or $-SO_2NH_2$, or furyl, thienyl, pyrimidyl, pyridyl or 2-benzimidazolyl, $R_4$ is hydrogen, alkyl having 1 to 5 carbon atoms, hydroxy- and mercapto-alkyl each having 1 to 3 carbon atoms, phenyl which is unsubstituted or substituted by alkyl having 1 to 4 carbon atoms, halogen, hydroxyl, amino, $-SO_3H$ or $-SO_2NH_2$, or benzyl, $R_5$ (if p is 1 or 2) is alkylene or alkylidene having not more than 6 carbon atoms, which is unsubstituted or substituted by alkyl having 1 to 4 carbon atoms, phenyl, halogen, hydroxyl, mercapto or amino, phenylene, which is unsubstituted or substituted by alkyl having 1 to 4 carbon atoms, halogen, hydroxyl, amino, —COOH, $-SO_3H$ or $-SO_2NH_2$, or α,2-, α,3- or α,4-benzylene, $R_{11}$ is hydrogen, alkyl having 1 to 5 carbon atoms, carboxyalkyl having 1 to 3 carbon atoms in the alkyl moiety, phenyl, which is unsubstituted or substituted by alkyl having 1 to 4 carbon atoms, halogen, hydroxyl, amino, $-SO_3H$ or $-SO_2NH_2$, or benzyl, or also —if p is 1—a direct chemical bond. $R_{12}$ (if q is 1 or 2) is alkylene or alkylidene having not more than 6 carbon atoms, which is unsubstituted or substituted by alkyl having 1 to 4 carbon atoms, phenyl, halogen, hydroxyl or amino, phenylene or aralkylene (benzylene or phenylethylene), which are unsubstituted or substituted by alkyl having 1 to 4 carbon atoms, halogen, hydroxyl, amino, —COOH, $-SO_3H$ or $-SO_2NH_2$, $-(CH_2)_{s-1}-CONH(CH_2)_{t-1}$ or -if q is 1-a direct chemical bond; if desired, $R_{12}$ can also be acetyl or benzoyl, which are unsubstituted or substituted by alkyl having 1 to 3 carbon atoms or halogen; $W_2$ is —COOM or $-SO_3M$ and M is a monovalent cation; $m_2$, p and q are each 1 or 2 and s and t are each an integer from 1 to 3.

Particularly preferred mercaptans of the formula (10) have the formulae $$HS-\begin{matrix}R_6\\|\\C\\|\\R_7\end{matrix}-R_8-COOM \quad (12)$$

in which $R_6$ is hydrogen, methyl, ethyl or phenyl, $R_7$ is hydrogen, methyl, phenyl, tolyl or carboxymethyl, $R_8$ is a direct chemical bond, $$-(CH_2)_u-,\ -\underset{CH_3}{\underset{|}{CH}}-,\ -\underset{CH_3}{\overset{CH_3}{\underset{|}{\overset{|}{C}}}}- \text{ or } -\underset{NH_2}{\underset{|}{CH}}-,$$

M is a monovalent cation and u is an integer from 1 to 3, and

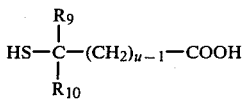

(13)

in which $R_9$ and $R_{10}$ are each hydrogen, methyl or phenyl and u is an integer from 1 to 3, whilst particularly suitable Bunte salts are the compounds of the formulae

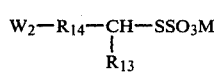

(14)

in which $R_{13}$ is hydrogen, methyl, ethyl, phenyl or carboxymethyl, $R_{14}$ is a direct chemical bond,

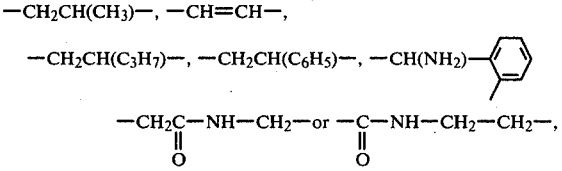

$W_2$ is —COOH or —$SO_3M$, M is a monovalent cation and v is an integer from 1 to 6, and

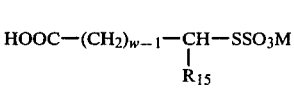

(15)

in which $R_{15}$ is hydrogen, methyl or phenyl, M is a monovalent cation and w is 1 or 2.

The mercapto compounds and Bunte salts to be used according to the invention are compounds which are known per se and which are prepared by known methods. (cf., for example, R. Kerber, Tetr.Letters 1966, page 3,007, B. Milligan and J. Swan, Rev. pure and appl. chem. 12, 72 (1962) and H. Distler, Angew.Chem. 79, 520 (1967)).

A preferred process for the preparation of the sulfur compounds described above, and especially of the β-mercaptocarboxylic acids and derivatives thereof, comprises introducing the —SH or —$SSO_3M$ groups into an α,β-unsaturated carboxylic acid or derivatives thereof. Suitable reagents are, for example, hydrogen sulfide, thioacetic acid, carbon disulfide and derivatives thereof, thiourea and inorganic thiosulfates.

Suitable compounds for carrying out this process are, for example, the following unsaturated acids and their derivatives: acrylic acid, methacrylic acid, acrylonitrile, crotonic acid, 2- and 3-pentenic acid, isopropylidenemalonic acid, itaconic acid, maleic anhydride, crotononitrile, vinylacetic acid, citraconic acid, ethyl propiolate, mesaconic acid, allylacetic acid, 3,3-dimethylacrylic acid, tiglic acid, allylthioacetic acid, trans-aconitic acid, diethyl glutaconate, 2-hexenedioic acid dinitrile, allylmalonic acid, diethyl allylmalonate, 3-hexenedioic acid, 2-hexenoic acid, 3-cyclohexene-1-carboxylic acid, 6-heptenoic acid, cinnamic acid, methyl cinnamate, ethyl cinnamate, α-methylcinnamic acid, 4-methylcinnamic acid, 2-, 3- or 4-methoxycinnamic acid, 4-hydroxycinnamic acid, 4-chlorocinnamic acid, 4-sulfamoyl-cinnamic acid, 3-hydroxy-4-methoxycinnamic acid, ethyl 4-sulfocinnamate, 2-carboxycinnamic acid, 3,4-methylene-dioxycinnamic acid, 2,3- or 3,4-dimethoxycinnamic acid, 3-(2'-furyl)-acrylic acid, 3-(2'-thienyl)-acrylic acid, 3-(3'-pyridyl)-acrylic acid, 3-(2'-pyridyl)-acrylic acid, 3-(4'-pyridyl)-acrylic acid, 5-norbornene-2-acrylic acid, 2-cyclopentenyl-1-acetic acid, 5-norbornene-2-carboxylic acid, bicyclo[2.2.2]oct-7-ene-2,3,5,7-tetracarboxylic acid anhydride, methyl 2-nonenoate, ethyl phenylpropiolate, diethyl diallylmalonate, styrylacetic acid, 4-cyclooctene-1-carboxylic acid, 4-cycloheptene-1-carboxylic acid and 4,4'-diaminostilbene-3,3'-dicarboxylic acid. Furthermore, the acid halides of the said acids can also be employed. Furthermore, it is also possible to prepare Bunte salts by sulfonation of the corresponding mercaptans. Of course, other alkylating agents, especially 3-membered to 6-membered oxygen-heterocyclic compounds, for example epoxides, lactones or sultones, can also be employed for the preparation of the sulfur compounds to be used according to the invention.

| Examples of mercaptans | (Component a) |
|---|---|
| $HOOC—CH_2—SH$ | 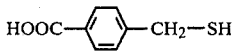 |
| $HOOC—CH_2—CH_2—SH$ | |
| $HOOC—CH_2—CH_2—CH_2—SH$ | $CH_3—SO_2—CH_2—CH_2—SH$ |
| $HOOC—CH(NH_2)—CH_2—SH$ | $HS—CH_2—CH(OH)—CH(OH)—CH_2—SH$ |
| $H_2N—C(=O)—CH_2—SH$ | |
| $HOC_2H_4—NH—CO—CH_2—CH_2—SH$ | 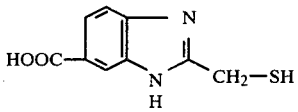 |
| $HO—CH_2—CH(OH)—CH_2—NH—CO—CH_2—SH$ | |
| $HOOC—CH_2—NH—CO—CH_2—SH$ | 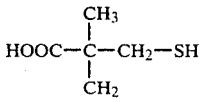 |

-continued

| Examples of mercaptans | (Component a) |
|---|---|
| 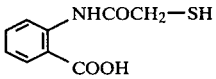 | |
| $(HO-C_2H_4)_2N-\overset{O}{\overset{\|\|}{C}}-CH_2-SH$ | 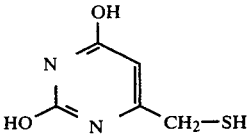 |
| $H_2N-C_2H_4-SH$ | $HOOC-\underset{\underset{CH_2SH}{\|}}{CH}-CH_2-SH$ |
| 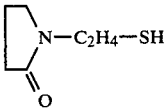 | $KO_3S-C_6H_4-NH-CO-CH_2-SH$ |
| $H_2N-\overset{O}{\overset{\|\|}{C}}-NH-C_2H_4-SH$ | $HOOC-\underset{\underset{CH_2-COOH}{\|}}{CH}-CH_2-SH$ |
| 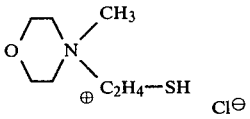 | 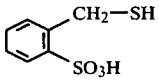 |
| $HO-CH_2-\underset{\underset{OH}{\|}}{CH}-CH_2-SH$ | $(CH_3)_3\overset{\oplus}{N}-CH_2-CH_2-SH$ |
| $HOOC-\underset{\underset{NH_2}{\|}}{CH}-CH_2-CH_2-SH$ | $HOOC-\underset{\underset{CH_2-CH_3}{\|}}{CH}-SH$ |
| $HOOC-\underset{\underset{NH_2}{\|}}{\overset{\overset{CH_3}{\|}}{C}}-CH_2-SH$ | $HOOC-(CH_2)_2-\underset{\underset{CH_3}{\|}}{CH}-SH$ |
| $HOOC-C_2H_4-SO_2-CH_2-CH_2-SH$ | $HOOC-CH_2-\underset{\underset{CH_2-CH_3}{\|}}{CH}-SH$ |
| $H_2O_3P-(CH_2)_3-SH$ | $KO_3S-CH_2-\underset{\underset{CH_3}{\|}}{CH}-SH$ |
| $CH_3-\underset{\underset{O}{\|\|}}{C}-CH_2-SH$ | $Na-OOC-\underset{\underset{CH_3}{\|}}{\overset{\overset{CH_3}{\|}}{C}}-CH_2-\overset{\overset{CH_3}{\|}}{CH}-SH$ |
| $NaO_3S-(CH_2)_2-SH$ | $HOOC-\underset{\underset{CH_3}{\|}}{\overset{\overset{CH_3}{\|}}{C}}-SH$ |
| $NaO_3S-(CH_2)_3-SH$ | $HOOC-\underset{\underset{NH_2}{\|}}{CH}-\underset{\underset{CH_3}{\|}}{\overset{\overset{CH_3}{\|}}{C}}-SH$ |
| $NaO_3S-(CH_2)_4-SH$ | |
| $NaO_3S-\underset{\underset{CH_3}{\|}}{CH}-(CH_2)_2-SH$ | |
| $NaO_3S-\underset{\underset{C_6H_5}{\|}}{CH}-(CH_2-\underset{\underset{CH_3}{\|}}{CH}-SH$ | |
| $NaO_3S-\underset{\underset{CH_3}{\|}}{CH}-CH_2-\underset{\underset{CH_3}{\|}}{CH}-SH$ | $HOOC-CH_2-\underset{\underset{CH_3}{\|}}{\overset{\overset{CH_3}{\|}}{C}}-SH$ |
| $NaO_3S-(CH_2)_2-\underset{\underset{CH_3}{\|}}{CH}-SH$ | 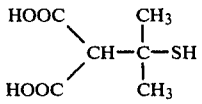 |
| $HOOC-\underset{\underset{CH_3}{\|}}{CH}-SH$ | |

-continued
| Examples of mercaptans | (Component a) |
|---|---|
| $HOOC-CH_2-CH(CH_3)-SH$ | $HOOC-C(C_6H_5)_2-SH$ |
| 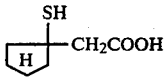 | $HOOC-CH_2-CH(C_6H_5)-SH$ |
| 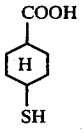 | $HOOC-CH(C_6H_5)-SH$ |
| 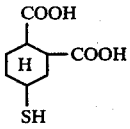 | $HOOC-CH_2-CH(C_6H_4-CH_3)-SH$ , $HOOC-CH_2-CH(C_6H_4-SO_2NH_2)-SH$ |
| 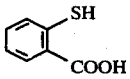 | 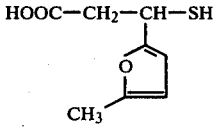 |
| 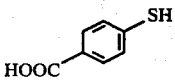 | |
| 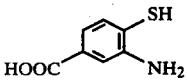 | 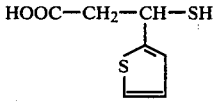 |
| 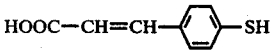 | 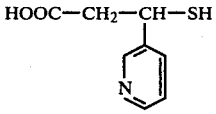 |
| 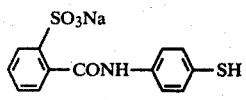 | $HOOC-CH(CH_2C_6H_5)-SH$ |
| 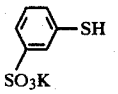 | $HOOC-CH=C(C_6H_5)-SH$ |
| 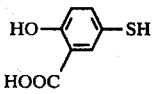 | $HOOC-CH(SH)-(CH_2)_2-CH(COOH)-SH$ |
| $HOOC-CH_2-CH(COOH)-SH$ | 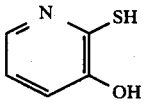 |
| $HOOC-CH(COOH)-SH$ | |
| 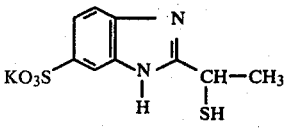 | 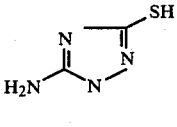 |
| 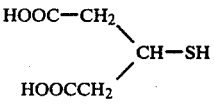 | 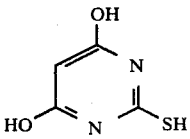 |

-continued
| Examples of mercaptans | (Component a) |
|---|---|
| $HOOC(CH_2)_4-CH(CH_2-CH_2-OH)-SH$ | 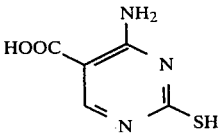 |
| $HOOC-(CH_2)_4-CH(CH_2-CH_2-SH)-SH$ | 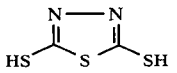 |
| 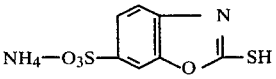 | 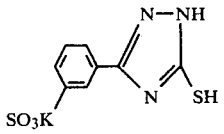 |
| 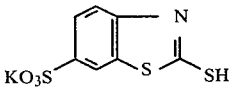 | |
| 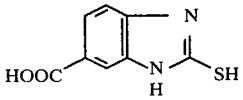 | 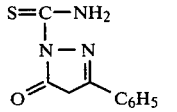 |
| 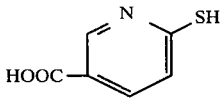 | 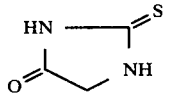 |
| 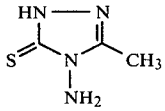 | 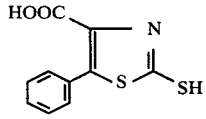 |
| 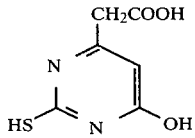 | 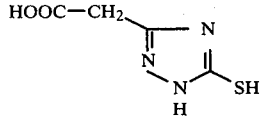 |
| 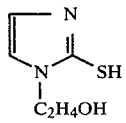 | 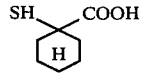 |
| | 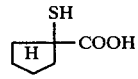 |
| 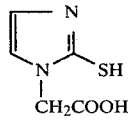 | 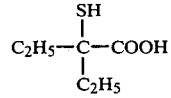 |
| | 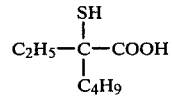 |
| 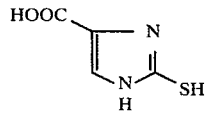 | 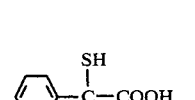 |
| 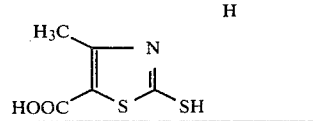 | |
| |  |
|  | |

Examples of Bunte salts (Component b)

$NaO_3S-CH_2-CH_2-SSO_3M$ $KO_3S-(CH_2)_3-SSO_3M$ $NaO_3S-(CH_2)_4-SSO_3M$ $NaO_3S-CH_2-CH_2-CH(CH_3)-SSO_3M$ $NaO_3S-(CH_2)_7-SSO_3M$ $NaO_3S-CH(C_3H_9)-CH_2-CH(CH_3)-SSO_3M$ $NaO_3S-CH(C_6H_5)-CH_2-CH(CH_3)-SSO_3M$

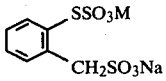

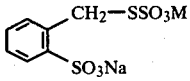

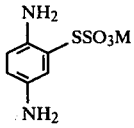

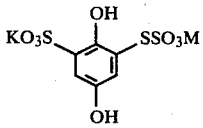

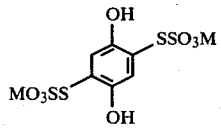

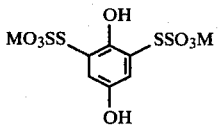

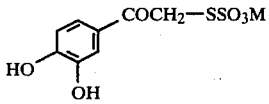

$HOOC-CH(NH_2)-CH_2-SSO_3M$ $Na-OOC-CH_2-SSO_3M$ $HOOC-CH_2-CH_2-SSO_3M$ $H_2N-C(=O)-CH_2-SSO_3M$ $H_2N-C(=O)-CH_2-CH_2-SSO_3M$ $H_2N-CH_2-CH_2-SSO_3M$

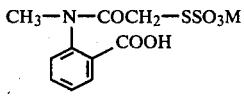

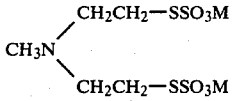

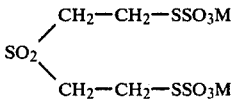

-continued

Examples of Bunte salts (Component b)

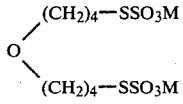

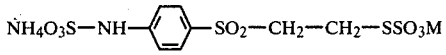

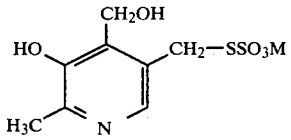

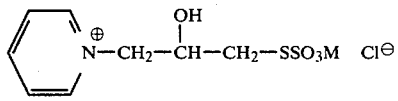

$HOOC(CH_2)_3-SSO_3M$ $HOOC-CH_2-CH(SSO_3M)-CH_3$ $HOOC-CH_2-CH(SSO_3M)-C_6H_5$ $HOOC-CH_2-NH-CO-CH_2-SSO_3M$

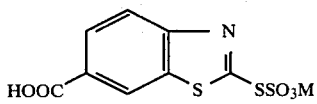

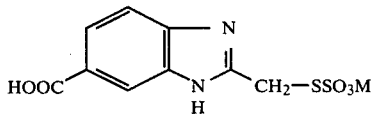

$H_2N-CH_2-CH(OH)-CH_2-SSO_3M$

M = a monovalent cation, preferably the sodium, potassium or ammonium cation

The preferably aqueous developer solutions for developing a photographic material which has been exposed image-wise, which are to be used according to the invention, can in other respects have the compositions known per se.

For example, they contain dihydroxybenzenes, aminophenols, diaminobenzenes, pyrazolidinones, reductones or hydroxylamine derivatives as conventional compounds which develop silver halide.

Conventional water-soluble silver halide solvents are, for example, thioethers or thioamides, salts of thiocyanic acid, salts of sulfurous acid (sulfites) in high concentration and, preferably, salts of thiosulfuric acid (thiosulfates). The sulfites can, for example, as a rule be employed in an amount of more than 20 g/l, and if desired also in smaller amounts, for example 10 to 20 g/l, and the thiocyanates and thiosulfates can be employed in a concentration of 0.1 to 200 g/l, in the aqueous preparations.

The concentration of the thiosulfate is advantageously 10 to 200 g/l when used in a monobath and 0.1 to 10 g/l for masking developers for silver dye-bleach material. Suitable sulfur compounds are, in particular, those of the formulae (9) to (15). The sulfur compounds can also be used in developer preparations for reversal, chromogenic, X-ray or black-and-white film materials.

Components (a) and (b) are preferably added to the aqueous developer preparation in amounts of 0.01 to 1 g/l and of 0.1 to 10 g/l respectively.

Thus, suitable developer solutions contain, for example, 0.1 to 20 g/l of the compound which develops silver halide, 0.1 to 200 g/l of the silver halide solvent and 0.05 to 10 g/l of the combination of components (a) and (b), the molar ratio of (a):(b) being 5:1 to 1:100 and preferably 1:1 to 1:20.

When preparing the aqueous developer preparations of the present invention it proves advantageous to mix in the combination of (a) and (b) some time before using the developer solution. The quantity ratio of Bunte salts to mercapto compounds can be varied within the indicated limits.

The developer solutions can be prepared, for example, from a single concentrate or from separate concentrates of the compound which develops silver halide, the silver halide solvent and the combination of components (a) and (b), and also, if desired, further components, by diluting with water, which can be mixed with organic solvents.

The concentrates can be in the form of a liquid or paste and if desired can also be in the solid form and, per liter of concentrate, can contain, for example, the individual components in 2 to 25 times the amount in which they are present in the ready-to-use developer solutions.

A very particularly valuable application of the present process comprises developing silver dye-bleach material, which has a layer build-up suitable for lowering the undesired secondary colour densities, with a developer preparation of the indicated composition.

Preferably, this relates to the process for the production of masked, subtractive, positive coloured images by the silver dye-bleach process, by exposure, silver developing, dye-bleaching, silver-bleaching and fixing and with the use of a photographic material which contains one image-wise bleachable dye in each of at least two layers, the absorption maximum of each dye corresponding to one of the three primary colours red, green and blue and a silver halide emulsion layer sensitive in a specific spectral region being assigned to each dye, and a silver halide emulsion layer which at least partially consists of silver iodide being assigned, in this material, to the dye which has the undesired secondary colour density which is to be compensated, there being at least a second dye, which has a main colour density which corresponds to a secondary colour density, of the first dye, which is to be compensated, and a silver halide emulsion which is free from iodide ions in a further layer and, moreover, a further layer, which is adjacent to that containing the second dye, containing colloidal nuclei which are capable of depositing metallic silver from soluble silver complexes and a septum being located between the layer containing the nuclei and the dye layer which has the secondary colour density which is to be compensated, and the silver developing bath with which the material is to be treated after exposure has taken place containing a ligand, which is able to produce water-soluble and diffusible silver complexes, as well as a combination of the compounds of the formulae (1) or (2) and (3). Particularly preferred combinations are those of compounds of the formulae (13) and (15).

The mixtures, to be used according to the invention, of mercapto compounds and Bunte salts are distinguished, inter alia, by the fact that they prevent the deposition of silver in developer solutions for an astonishingly long time. In contrast to the anti-sediment agents used hitherto, the mixtures of (a) and (b), which are used according to the invention, are otherwise photographically virtually inactive and very stable under the customary conditions, and this is advantageous in particular for a continuous procedure using the developers described.

In the examples which follow parts and percentages are by weight.

EXAMPLE 1

A photographic material for the silver dye-bleach process is prepared on a pigmented cellulose acetate base using the cyan image dye of the formula (101)

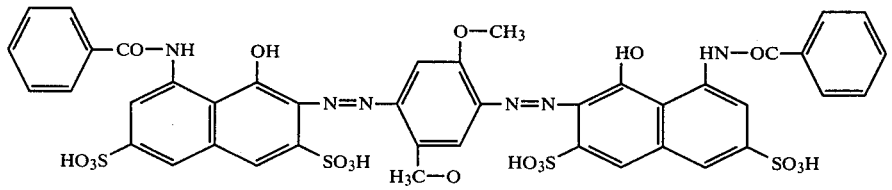

in the red-sensitised bottommost layer, the magenta dye of the formula (102)

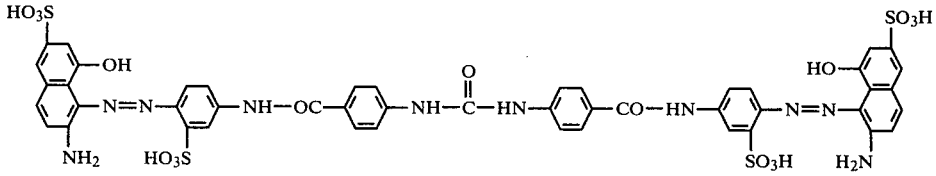

in a green-sensitised layer above this and the yellow dye of the formula (103)

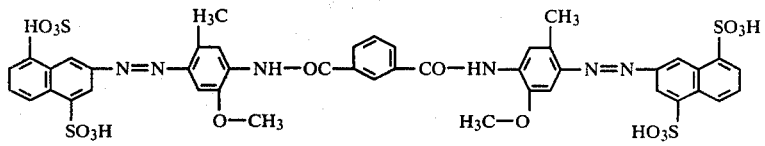

in a blue-sensitive layer which is above the magenta layer.

The photographic material used is built up as follows (cf. German Offenlegungsschriften Nos. 2,036,918, 2,132,836 and 2,547,720):

Gelatin protective layer
Blue-sensitive, iodide-free AgBr emulsion
Yellow dye (103)+blue-sensitive, iodide-free AgBr emulsion
Yellow filter: yellow Ag hydrosol (40 mg/m$^2$)
Green-sensitive AgBr/AgI emulsion
Magenta dye (102)+green-sensitive AgBr/AgI emulsion
Intermediate layer (gelatin)
Cyan dye (101)+red-sensitive AgBr/AgI emulsion
Red-sensitive AgBr/AgI Emulsion
Cellulose triacetate base, white opaque
Backing, gelatin The layer build-up enables the blue secondary colour densities of the cyan dye and magenta dye to be corrected by additional bleaching of the yellow image dye as a function of the bleaching of the two other image dyes (blue-sensitive layer with yellow dye iodide-free; other dye layers with iodide-containing emulsion). The nuclei-containing layer is adjacent to the yellow dye layer. It additionally contains a yellow light filter dye and is separated from the magenta layer by a colourless emulsion layer (green-sensitive AgI-containing emulsion layer, which at the same time is the separating layer).

The iodide-containing emulsion layers contain crystals with 2.6 mol % of silver iodide and 97.4 mol % of silver bromide. The image dyes are used in a concentration such that their reflectance densities are each 2.0; the total silver content of the 22$\mu$ thick layers is 2.0 g/m$^2$.

A coloured slide is copied on this material in an enlarger. The exposed material is processed in accordance with the following instructions (French Patent Specification No. 2,247,755). The processing temperature is 30° C.

| | |
|---|---|
| 1. Silver developing bath 3 minutes | |
| tetrasodium salt of ethylenediamine-tetraacetic acid | 2 g/l |
| 85% potassium hydroxide | 30 g/l |
| boric acid | 16 g/l |
| potassium metabisulfite | 26 g/l |
| 1-phenyl-3-pyrazolidinone | 0.35 g/l |
| hydroquinone | 5 g/l |
| benztriazole | 0.8 g/l |
| potassium bromide | 2 g/l |
| anhydrous sodium thiosulfate | 0.8 g/l |
| compound of the formula (104) | 0.5 g/l |
| compound of the formula (105) | 0.85 g/l |

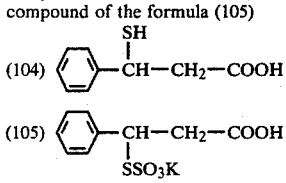

(component (a))

(component (b))

-continued

| | |
|---|---|
| 2. Washing 1 minute | |
| 3. Bleaching bath 5 minutes | |
| sulfamic acid | 100 g/l |
| sodium m-nitrobenzenesulfonate | 10 g/l |
| 1-thioglycerol | 1 ml/l |
| potassium iodide | 6 g/l |
| 2,3,6-trimethylquinoxaline | 2 g/l |
| 4. Washing 1 minute | |
| 5. Fixing bath 4 minutes | |
| ammonium thiosulfate | 250 g/l |
| potassium metabisulfite | 50 g/l |
| 85% potassium hydroxide | 20 g/l |
| 6. Washing 6 minutes | |

Total processing time 20 minutes

The reflection print of the slide which is obtained after drying is distinguished by faithful reproduction of the tonalities and by unadulterated colour reproduction.

As a result of the addition of the two compounds (formula (104) and formula (105)), the developer is usable for a relatively long time. Even after processing several colour enlargements, the solution remains clear, i.e. free from the deposition of metallic silver.

If only the compound of the formula (104) is added to the developer, the solution does indeed remain clear for a relatively long time, but the developer characteristics are changed: in the developed colour printing material, the yellow gradation in the shadows is too flat; the gradation equilibrium is thus disturbed. Colour prints processed with this developer have fewer saturated yellow tones. Moreover, darker parts of the image appear bluish-tinged.

If the developer contains only the compound of the formula (105), the solution becomes decolorised a short time after it is used; metallic silver separates out.

In place of the combination of the compounds of the formulae (104) and (105), it is also possible to employ other combinations of mercaptans and Bunte salts from the tables given above.

EXAMPLE 2

Material for the silver dye-bleach process is processed in accordance with Example 1 but the compounds of the formulae (106) $CH_3-\underset{\underset{SH}{|}}{CH}-CH_2-COOH$ 0.5 g/l (107) $CH_3-\underset{\underset{S-SO_3K}{|}}{CH}-CH_2-COOH$ 1 g/l are used in the silver developing bath.

The developing time is 2 minutes at a temperature of 30° C. After drying, reflection prints of good image quality are obtained. Even when the developer is used repeatedly (total of 0.1 m$^2$ of material per liter of solution), no change in the image quality and no turbidity in the solution are to be found.

EXAMPLE 3

A black-and-white developer of the following composition is prepared:

| | |
|---|---|
| potassium carbonate | 30 g |
| sodium sulfite | 100 g |
| potassium bromide | 3 g |
| hydroquinone | 40 g |
| ethylenediaminetetraacetic acid (disodium salt) | 1.5 g |
| potassium hydroxide | 17 g |
| water to make up to | 1 liter |

The solution is divided into two 500 ml portions A and B.

0.5 g of the compound of the formula (104) is added to portion A.

0.5 g of 2-aminoethane-thiolsulfonic acid and 0.5 g of the compound of the formula (104) are added to portion B.

Black-and-white camera films are developed with these solutions. Portion A remains clear for a certain time but turbidity due to a silver sediment can then be observed. The developer characteristics of this solution change in the manner indicated in Example 1.

Portion B, on the other hand, remains clear and retains its good developer characteristics even after prolonged use.

EXAMPLE 4

A black-and-white developer of the following composition

| | |
|---|---|
| 4-methylaminophenol-sulfate | 2 g |
| hydroquinone | 5 g |
| sodium sulfite (anhydrous) | 100 g |
| borax | 3 g |
| water to make up to | 1 liter |

is mixed with 0.5 g of the compound of the formula (104) and 0.85 g of the compound of the formula (105).

Black-and-white camera films are each developed for 6 minutes at 20° C. with this solution in a tank. After a total of 10 36 exposure, size 135 films have been developed, the solution starts to become exhausted and must either be regenerated or replaced by fresh solution. In contrast to a developer solution which has been prepared without the addition of the compounds of the formulae (104) and (105), there is still no trace of the formation of silver sediment at this time.

What is claimed is:

1. A process for the prevention of darkening and the formation of a sediment in photographic developer solutions which contain a compound which develops silver halide, a water-soluble silver halide solvent and organic sulfur compounds, which comprises adding to the developer solution, as organic sulfur compounds, a combination of (a) a compound of the formulae $$HS-D\text{-}(W)_n \text{ or } S{=}\underset{\underset{R_1}{|}}{C}-\underset{\underset{R_2}{|}}{A}-H$$

and (b) a Bunte salt of the formula $$(Z)_m-E-(B)_{r-1}-SSO_3M$$

in which formulae A is a nitrogen atom, a carbon atom bonded via a double bond $$(=\overset{|}{C}-) \text{ or } -\underset{|}{\overset{|}{CH}} \text{ and B is } -\underset{\underset{O}{\|}}{C}- \text{ or } -\underset{\underset{O}{\|}}{CH_2C}-,$$

$R_2$ is hydrogen, substituted or unsubstituted alkyl, substituted or unsubstituted phenyl or a substituted or unsubstituted, saturated or unsaturated 5-membered or 6-membered heterocyclic radical containing nitrogen, oxygen and/or sulfur atoms and $R_1$ has the meaning defined for $R_2$ with the exception of hydrogen, or $R_1$ and $R_2$ together with the atoms to which they are bonded form a 4-membered, 5-membered or 6-membered heterocyclic ring, D and E are each a substituted or unsubstituted aliphatic, araliphatic, cycloaliphatic, aromatic or heterocyclic radical and W and Z are each a radical of the formulae $$-COOM,\ -SO_3M,\ -SSO_3M,\ -\underset{\underset{O}{\|}}{P}\begin{matrix}/OY\\ \backslash OM\end{matrix},$$

$$-OH,\ -\underset{\underset{Y}{|}}{N}-SO_3M,\ -SO_2\overset{\overset{Y}{|}}{N}-Y,\ -\overset{\oplus}{N}\begin{matrix}/X\\ \backslash Y\end{matrix}\ (G),$$

$$A_1^{\ominus},\ -N\begin{matrix}/X\\ \backslash Y\end{matrix},\ -CON\begin{matrix}/X\\ \backslash Y\end{matrix},\ -SO_2-X \text{ or } -SO_2M$$

or a polyoxyethylene radical which has 2 to 20 oxyethylene units and can be sulfonated, in which formulae G, X and Y are each hydrogen or are alkyl having 1 to 6 carbon atoms which is substituted by hydroxyl, carboxyl or $-SO_3H$ and Y is also phenyl, phenylsulfonic acid, alkylsulfonyl having 1 to 5 carbon atoms, phenylsulfonyl or tolylsulfonyl, and $A_1^{\ominus}$ is a monovalent anion and M is a monovalent cation, and n and m are each an integer from 1 to 4 and r is 1 or 2.

2. A process according to claim 1, wherein the Bunte salt has the formula $(Z)_m-E-SSO_3M$, in which E, M, Z and m are as defined in claim 1.

3. A process according to claim 1, wherein component (a) is a mercaptan of the formula $$HS-D_1-(W_1)_{n1}$$

and component (b) is a Bunte salt of the formula $$(Z_1)_{m1}-D_1-SSO_3M$$

in which formulae $D_1$ in each case is an aliphatic, araliphatic or aromatic radical having not more than 40 carbon atoms or a heterocyclic 5-membered or 6-membered ring which contains 1 to B 4 nitrogen atoms, one oxygen atom and/or one sulfur atom and can be fused with a benzene ring, $$W_1 \text{ is } -COOM,\ -SO_3M,\ -OH \text{ or } CON\begin{matrix}/X\\ \backslash Y\end{matrix} \text{ and } Z_1 \text{ is}$$

-continued $$-COOM,\ -SO_3M,\ -SSO_3M,\ -OH,\ -CON\begin{matrix}X\\Y\end{matrix}\ \text{or}\ -N\begin{matrix}X\\Y\end{matrix},$$

$n_1$ and $m_1$ in each case are an integer from 1 to 3 and M, X and Y are as defined in claim 1.

4. A process according to claim 3, wherein component (a) is a mercaptan of the formula $$HS-D_2-(W_1)_{n2}$$

in which $D_2$ is an aliphatic or araliphatic radical having not more than 20 carbon atoms or a substituted or unsubstituted benzene radical and $n_2$ is 1 or 2 and $W_1$ is as defined in claim 3.

5. A process according to claim 4, wherein component (a) is a mercaptan of the formula $$HS-D_2-(W_2)_{n2}$$

and component (b) is a Bunte salt of the formula $$(Z_2)_{m2}-D_2-SSO_3M$$

in which formulae $D_2$ in each case is an aliphatic or araliphatic radical having not more than 20 carbon atoms or a substituted or unsubstituted benzene radical, $W_2$ is —COOH or —$SO_3M$, $Z_2$ is —COOM, —$SO_3M$, —$SSO_3M$, —$NH_2$ or —OH and M is a monovalent cation and $n_2$ and $m_2$ are each 1 or 2.

6. A process according to claim 5, wherein component (a) is a mercaptan of the formula HS—$D_3$—COOM, in which $D_3$ is phenylene which is unsubstituted or substituted by alkyl having 1 to 4 carbon atoms, halogen or amino and M is a monovalent cation.

7. A process according to claim 6, wherein $D_2$ is a straight-chain or branched alkylene having 1 to 10 carbon atoms, which is optionally interrupted by —O—, $SO_2$—, —NH— or —NR—, in which R is alkyl having 1 to 4 carbon atoms.

8. A process according to claim 5, wherein component (a) is a mercaptan of the formula $$HS-\left[\begin{matrix}R_3\\|\\C\\|\\R_4\end{matrix}\right]_{2-p}-R_5-W_2$$

and component (b) is a Bunte salt of the formula $$(Z_2)_{m2}-R_{12}-\left(\begin{matrix}CH\\|\\R_{11}\end{matrix}\right)_{2-q}-SSO_3M$$

in which formulae $R_3$ is hydrogen, alkyl having 1 to 5 carbon atoms, carboxyl, carboxyalkyl having 1 to 3 carbon atoms in the alkyl moiety, phenyl, which is unsubstituted or substituted by alkyl having 1 to 4 carbon atoms, halogen, hydroxyl, amino, —$SO_3H$, —COOH or —$SO_2NH_2$, or furyl, thienyl, pyrimidyl, pyridyl or 2-benzimidazolyl, $R_4$ is hydrogen, alkyl having 1 to 5 carbon atoms, hydroxy- and mercapto-alkyl each having 1 to 3 carbon atoms, phenyl which is unsubstituted or substituted by alkyl having 1 to 4 carbon atoms, halogen, hydroxyl, amino, —$SO_3H$ or —$SO_2NH_2$, or benzyl, $R_5$ is alkylene or alkylidene having not more than 6 carbon atoms, which is unsubstituted or substituted by alkyl having 1 to 4 carbon atoms, phenyl, halogen, hydroxyl, mercapto or amino, phenylene, which is unsubstituted or substituted by alkyl having 1 to 4 carbon atoms, halogen, hydroxyl, amino, —COOH, —$SO_3H$ or —$SO_2NH_2$, or α,2—, α,3— or α,4-benzylene or—if p is 1—a direct chemical bond, $R_{11}$ is hydrogen, alkyl having 1 to 5 carbon atoms, carboxyalkyl having 1 to 3 carbon atoms in the alkyl moiety, phenyl, which is unsubstituted or substituted by alkyl having 1 to 4 carbon atoms, halogen, hydroxyl, amino, —$SO_3H$ or —$SO_2NH_2$, or benzyl, $R_{12}$ is alkylene or alkylidene having not more than 6 carbon atoms, which is unsubstituted or substituted by alkyl having 1 to 4 carbon atoms, phenyl, halogen, hydroxyl or amino, phenylene or aralkylene, which are unsubstituted or substituted by alkyl having 1 to 4 carbon atoms, halogen, hydroxyl, amino, —COOH, —$SO_3H$ or —$SO_2NH_2$ or —$(CH_2)_{s-1}$—$CONH(CH_2)_{t-1}$ or—if q is 1—a direct chemical bond, $Z_2$ is —COOM, —$SO_3M$, —$SSO_3M$, —$NH_2$ or —OH, $W_2$ is —COOM or —$SO_3M$, M is a monovalent cation and $m_2$, p and q are each 1 or 2 and s and t are each an integer from 1 to 3.

9. A process according to claim 8, wherein component (a) is a mercaptan of the formula $$HS-\begin{matrix}R_6\\|\\C\\|\\R_7\end{matrix}-R_8-COOM$$

in which $R_6$ is hydrogen, methyl, ethyl or phenyl, $R_7$ is hydrogen, methyl, phenyl, tolyl or carboxymethyl, $R_8$ is a direct chemical bond, $$-(CH_2)_u-,\ -\underset{CH_3}{\underset{|}{CH}}-,\ -\underset{CH_3}{\underset{|}{\overset{CH_3}{\overset{|}{C}}}}-\ \text{or}\ -\underset{NH_2}{\underset{|}{CH}}-,$$

M is a monovalent cation and u is an integer from 1 to 3.

10. A process according to claim 9, wherein component (a) is a mercaptan of the formula $$HS-\begin{matrix}R_9\\|\\C\\|\\R_{10}\end{matrix}-(CH_2)_{u-1}-COOH$$

in which $R_9$ and $R_{10}$ are each hydrogen, methyl or phenyl and u is an integer from 1 to 3.

11. A process according to claim 8, wherein component (b) is a Bunte salt of the formula $$Z_2-R_{14}-\underset{R_{13}}{\underset{|}{CH}}-SSO_3M$$

in which $R_{13}$ is hydrogen, methyl, ethyl, phenyl or carboxymethyl, $R_{14}$ is a direct chemical bond, $$-(CH_2)_v-,\ -CH(CH_3)-,\ -C(CH_3)_2-,\ -CH_2CH(CH_3)-,$$
$$-CH{=}CH-,\ -CH_2CH(C_3H_7)-,\ -CH_2CH(C_6H_5)-,$$

-continued

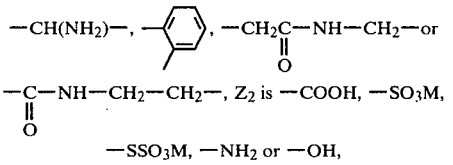

M is a monovalent cation and v is an integer from 1 to 6.

12. A process according to claim 11, wherein component (b) is a Bunte salt of the formula

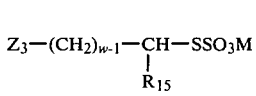

in which $R_{15}$ is hydrogen, methyl or phenyl, M is a monovalent cation, $Z_3$ is —COOH or —$NH_2$ and w is 1 or 2.

13. A process according to claim 8, wherein component (a) is a mercaptan of the formula

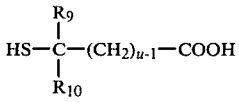

and component (b) is a Bunte salt of the formula

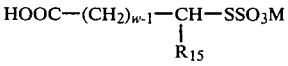

in which formulae $R_9$, $R_{10}$ and $R_{15}$ are each hydrogen, methyl or phenyl, M is a monovalent cation, u is an integer from 1 to 3 and w is 1 or 2.

14. A process according to claim 1, wherein the developer solution contains, as the silver halide solvent, a sulfite in a concentration of more than 20 g per liter or a water-soluble thiocyanate or thiosulfate.

15. A developer solution, for developing photographic recording material which contains silver halide and has been exposed image-wise, which contains a compound which develops silver halide, a water-soluble silver halide solvent and organic sulfur compounds, wherein the developer solution contains, as the organic sulfur compounds, a combination of (a) a compound of the formulae

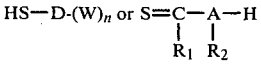

and (b) a Bunte salt of the formula

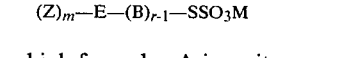

in which formulae A is a nitrogen atom, a carbon atom bonded via a double bond

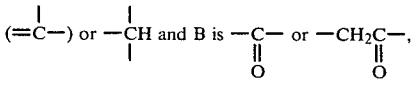

$R_2$ is hydrogen, substituted or unsubstituted alkyl, substituted or unsubstituted phenyl or a substituted or unsubstituted, saturated or unsaturated 5-membered or 6-membered heterocyclic radical containing nitrogen, oxygen and/or sulfur atoms and $R_1$ has the meaning defined for $R_2$ with the exception of hydrogen, or $R_1$ and $R_2$ together with the atoms to which they are bonded form a 4-membered, 5-membered or 6-membered heterocyclic ring, D and E are each a substituted or unsubstituted aliphatic, araliphatic, cycloaliphatic, aromatic or heterocyclic radical and W and Z are each a radical of the formulae

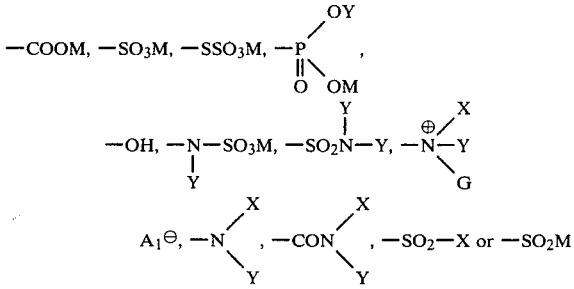

or a polyoxyethylene radical which has 2 to 20 oxyethylene units and can be sulfonated, in which formulae G, X and Y are each hydrogen or are alkyl having 1 to 6 carbon atoms which is substituted by hydroxyl, carboxyl or —$SO_3H$ and Y is also phenyl, phenylsulfonic acid, alkylsulfonyl having 1 to 5 carbon atoms, phenylsulfonyl or tolylsulfonyl, and $A_1\ominus$ is a monovalent anion and M is a monovalent cation, and n and m are each an integer from 1 to 4 and r is 1 or 2.

16. A developer solution according to claim 15 which is aqueous.

17. A developer solution according to claims 15 or 16, which contains 0.1 to 20 g/l of the compound which develops silver halide, 0.1 to 200 g/l of the silver halide solvent and 0.05 to 10 g/l of the combination of components (a) and (b), the molar ratio of (a):(b) being 5:1 to 1:100.

18. A developer solution according to claim 15 which is prepared from a single liquid or pasty concentrate of the silver halide developer, the silver halide solvent, the combination of components (a) and (b) and optionally further components by diluting with water or water/organic solvent mixtures, the amounts of the components being 0.2 to 500 g/l of the silver halide developer, 0.2 to 500 g/l of the silver halide solvent and 0.1 to 250 g/l of the combination of the components (a) and (b), the molar ratio of (a):(b) being 5:1 to 1:100.

19. A developer solution according to claim 15 which is prepared from separate liquid or pasty concentrates of the silver halide developer, the silver halide solvent, the combination of components (a) and (b) and optionally further components by diluting with water or water/organic solvent mixtures, the amount of the components being 0.2 to 500 g/l of the silver halide developer, 0.2 to 500 g/l of the silver halide solvent and 0.1 to 250 g/l of the combination of the components (a) and (b), the molar ratio of (a):(b) being 5:1 to 1:100.

20. A concentrate for the preparation of a developer solution according to claim 1 which contains 0.2 to 500 g/l of the silver halide developer, 0.2 to 500 g/l of the silver halide solvent, 0.1 to 250 g/l of the combination of the components (a) and (b), the molar ratio (a):(b)

being 5:1 to 1:100, and optionally further components, and being in a form of a liquid or a paste.

21. A liquid or pasty concentrate according to claim 20, which contains the individual components, per liter of concentrate, in amounts which are 2 to 25 times the following amounts: 0.1 to 20 g/l of the compound which develops silver halide, 0.1 to 200 g/l of the silver halide solvent and 0.05 to 10 g/l of the combination of components (a) and (b), the molar ratio of (a):(b) being 5:1 to 1:100.

* * * * *